US007637798B2

(12) United States Patent
Lutzi

(10) Patent No.: US 7,637,798 B2
(45) Date of Patent: Dec. 29, 2009

(54) BREAST LIFT APPARATUS

(75) Inventor: Juliana Lutzi, San Francisco, CA (US)

(73) Assignee: Pure Style, LLC, San Francisco, CA (US)

( * ) Notice: Subject to any disclaimer, the term of this patent is extended or adjusted under 35 U.S.C. 154(b) by 22 days.

(21) Appl. No.: 12/136,251

(22) Filed: Jun. 10, 2008

(65) Prior Publication Data

US 2009/0117825 A1 May 7, 2009

Related U.S. Application Data

(60) Provisional application No. 60/984,953, filed on Nov. 2, 2007.

(51) Int. Cl.
*A41C 3/00* (2006.01)

(52) U.S. Cl. ..... 450/81; 450/37

(58) Field of Classification Search ..... 450/81, 450/1, 36–38, 54–58; 424/448, 449; 602/58, 602/41, 42
See application file for complete search history.

(56) References Cited

U.S. PATENT DOCUMENTS

| | | | | |
|---|---|---|---|---|
| 1,783,512 | A * | 12/1930 | Mather | 450/81 |
| 6,200,195 | B1 * | 3/2001 | Furuno et al. | 450/81 |
| 6,350,175 | B2 * | 2/2002 | Johnson et al. | 450/81 |
| 6,371,831 | B1 * | 4/2002 | Dodge | 450/81 |
| 6,857,935 | B1 * | 2/2005 | Dohan | 450/81 |
| 7,122,236 | B2 * | 10/2006 | Mitchell et al. | 428/40.1 |
| 7,473,158 | B2 * | 1/2009 | Horton | 450/81 |

* cited by examiner

*Primary Examiner*—Gloria Hale
(74) *Attorney, Agent, or Firm*—Fliesler Meyer LLP

(57) ABSTRACT

A tape used to reduce the degree of breast ptosis of a human breast, wherein the tape can be attached to the bottom portion of a breast, placed over the nipple and areola, and then lifted and attached to the top portion of the breast.

20 Claims, 2 Drawing Sheets

BREAST LIFT APPARATUS

The present application claims the benefit of priority under 35 U.S.C. §119(e) to U.S. Provisional Patent Application entitled "Breast Lift Apparatus," Application No. 60/984,953, filed on Nov. 2, 2007, which application is incorporated herein by reference.

BACKGROUND

Over the years, factors such as loss of skin elasticity, pregnancy, nursing and/or the force of gravity ultimately affect the shape and firmness of the human breast. Not surprisingly, a vast number of products have been developed in an effort to help lift, shape and support human breasts. One such product is adhesive tape. In its simplest form, any piece of adhesive tape can be used to lift and support a breast by simply attaching one end of the tape to the bottom portion of a breast, lifting up on the tape, and then attaching the other end of the tape to the top portion of the breast. While the tape may achieve its desired function of reducing the degree of breast ptosis (the "droop" of the breast), use of a strip of adhesive tape in this manner leaves much to be desired. For example, removal of the tape will likely cause pain to the user, especially with respect to removal of the tape attached to the nipple which tends to be highly sensitive. Furthermore, the outline of the tape will likely be detectable through the user's clothing.

Specialized cosmetic tapes which are designed to lift and support breasts exist in the prior art; however, those breast lift tapes tend to have many of the same drawbacks as set forth above. For example, some breast lift tapes are designed to avoid the nipple and the areola. While these adhesive tapes eliminate the pain associated with removing the tape from the nipple, they also leave the nipple exposed underneath the user's clothing. This is undesirable as it allows the nipple to protrude through the user's clothing. Additionally, breast lift tape tends to be made from a very thin adhesive material in order to prevent the tape from being detectable underneath the user's clothing. This causes the breast lift tape to be difficult to apply. Accordingly, what is needed is a cosmetic tape which: reduces the degree of breast ptosis, conceals the nipple during use, is easy to apply, protects the nipple from the adhesive portion of the tape during use and allows the tape to be undetectable under the user's clothing.

BRIEF DESCRIPTION OF THE DRAWINGS

The accompanying drawings, which are incorporated into and constitute a part of this specification, illustrate one or more embodiments and, together with the detailed description, serve to explain the principles and implementations of the invention. In the drawings.

DETAILED DESCRIPTION

Embodiments are described herein in the context of a breast lift tape. Those of ordinary skill in the art will realize that the following detailed description is illustrative only and is not intended to be in any way limiting. Other embodiments of the present invention will readily suggest themselves to such skilled persons having the benefit of this disclosure. Reference will now be made in detail to implementations of embodiment of the present invention as illustrated in the accompanying drawings. The same reference indicators will be used throughout the drawings and the following detailed description to refer to the same or like parts.

The breast lift tape relates to a cosmetic tape that can be used to reduce the degree of breast ptosis. The breast lift tape generally includes a thin material having any predetermined shape, the predetermined shape including any shape which best accomplishes the goal of lifting and supporting a human breast. The breast lift tape is preferably non-opaque to prevent the tape from being detectable underneath the user's clothing. The size of the breast lift tape may also be varied depending on the cup size of the breasts. Accordingly, the breast tape may be die cut during the manufacturing process and/or be cut by the user after being purchased. The tape may include an adhesive applied to one side of the tape and a peel-away backing to cover the adhesive layer. The adhesive surface of the tape may also include a non-adhesive portion. The non-adhesive portion can have any shape or size and can be created by placing a separate thin, non-adhesive material on the adhesive surface. The breast lift tape may also include a top peel-away layer on the top surface of the tape which is opposed the bottom adhesive surface. The top peel-away layer can be used to maintain the tape's shape as the tape is applied to the breast.

The method of applying the breast lift tape can generally be described as follows. First, the peel-away backing is partially or completely removed from the adhesive surface. The base of the breast lift tape is then applied to the skin of the breast to a predetermined area below the nipple. The breast lift tape can be configured so that the non-adhesive portion covers the nipple and areola. After the tape is applied and secured to the skin below the nipple, the tape can be lifted in order to reduce the degree of breast ptosis to the extent desired by the user. The remainder of the breast lift tape can then be applied and secured to the skin above the nipple.

Figure 1:
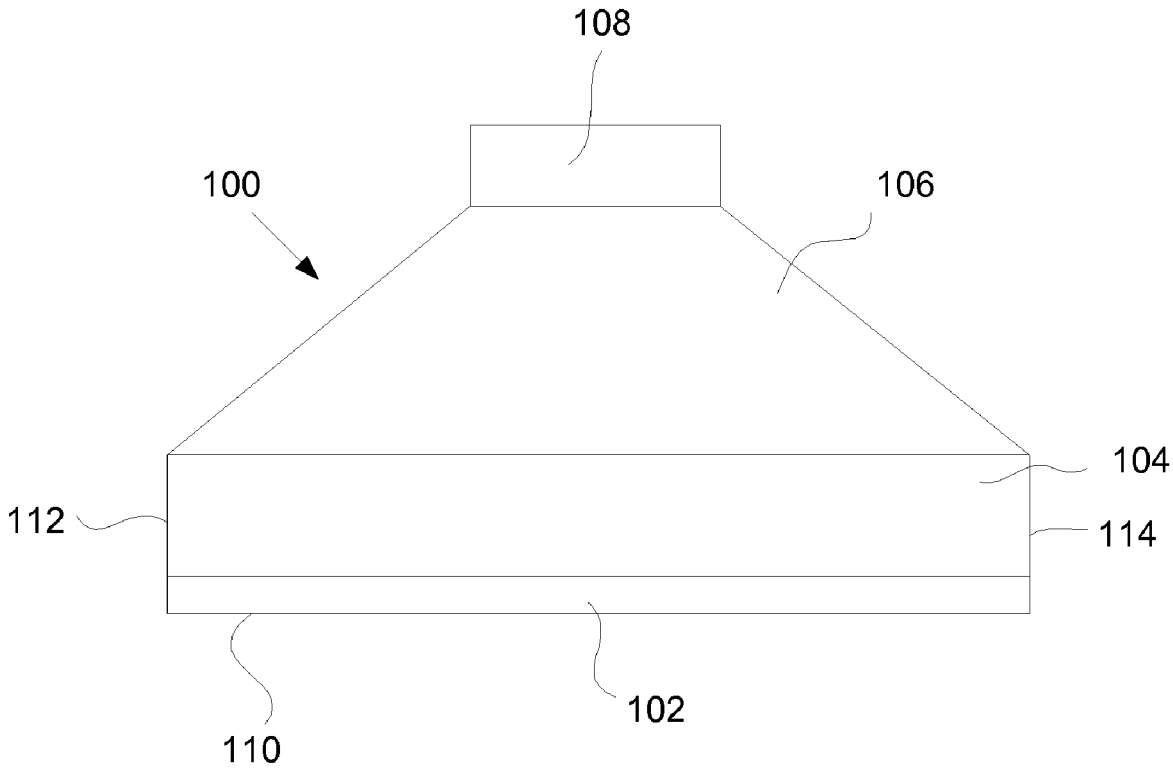
FIG. 1 illustrates a view of the bottom surface of an embodiment of the invention.
Figure 2:
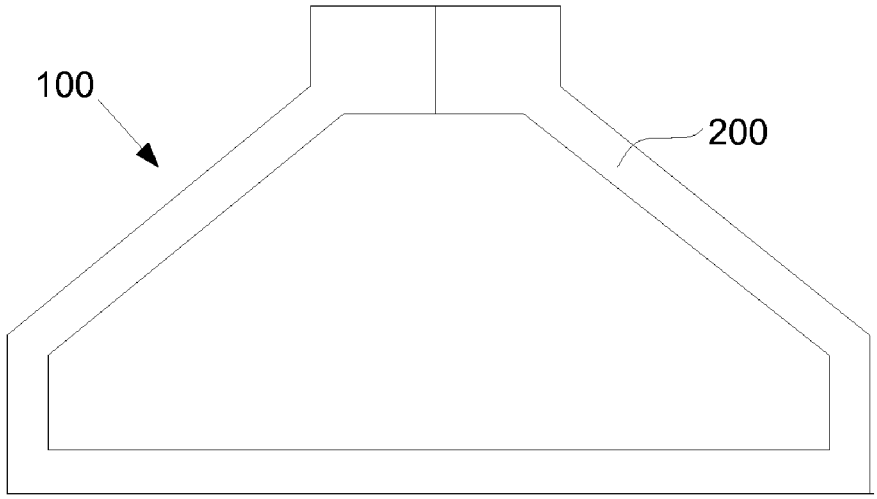
FIG. 2 illustrates a view of the top surface of an embodiment of the invention.

FIGS. 1 and 2 illustrate an embodiment of a breast lift tape. FIG. 1 illustrates the bottom surface of an embodiment (which includes the adhesive layer) while FIG. 2 illustrates the top surface of an embodiment. Referring now to FIG. 1, the breast lift tape, generally numbered 100, includes a first adhesive section 102, a non-adhesive section 104, a second adhesive section 106 and a top lining 108. In an embodiment, the height of the breast lift tape is approximately 3.25 inches and the width of the breast lift tape is 5.25 inches at the base 110.

The first adhesive section 102 is located at the base 110 of the breast lift tape 100. The first adhesive section 102 includes an adhesive and can be applied to the area of the breast below the nipple and areola. While the first adhesive section 102 is illustrated as being rectangular in shape, the first adhesive section 102 may generally be shaped as a semi-circle, a trapezoid, or any other shape which best accomplishes the goal of lifting and supporting a human breast that would be obvious to one skilled in the art without deviating from the scope of this invention. In an embodiment, the height of the first adhesive section 102 is 0.25 inches and the width is 5.25 inches.

The non-adhesive section 104 can be located between the first adhesive section 102 and the second adhesive section 106 as illustrated in FIG. 1. The non-adhesive section 104 is intended to overlay and/or conceal the nipple and areola. In an embodiment, the non-adhesive section 104 can be a rectangular in shape and extend from one side 112 of the breast lift tape 100 to the other side 114 of the breast lift tape 100. In another embodiment, the non-adhesive section 104 does not extend to the sides 112, 114 of the breast lift tape 100. The non-adhesive section 104 may include any shape, such as a circle, star, rectangle, etc., as long as it is sufficiently large enough to cover the nipple and areola. Accordingly, the non-adhesive section 104 can also be surrounded by adhesive material, thereby allowing the breast lift tape 100 to be secured to the side of the breast. The non-adhesive section 104 can be created by placing any non-adhesive material on an underlying adhesive surface. The thickness of the non-adhesive section 104 can be varied depending on the desired level of concealment for the nipple. The non-adhesive section 104 may be opaque or non-opaque. Additionally, while the non-adhesive section 104 is illustrated as being rectangular in shape, the non-adhesive section 104 may have any other shape (e.g. semi-circle, trapezoidal, etc.) which would be obvious to one skilled in the art without deviating from the scope of the invention. In an embodiment, the height of the non-adhesive section 104 is 1 inch and the width is 5.25 inches.

The second adhesive layer 106 can be located between the non-adhesive section 104 and the top lining 108. The second adhesive layer 106 includes an adhesive and can be applied to a predetermined area of the breast and/or chest above the nipple and areola. FIG. 1 illustrates the second adhesive layer 106 as having a trapezoidal shape. The trapezoidal shape of the second adhesive section 104 helps to conceal the breast lift tape 100 under the user's clothing while also providing sufficient surface area to support the weight of the breast. Nevertheless, the second adhesive layer 106 can also have any other shape (e.g., rectangle, semi-circle, etc.) which best accomplishes the goal of lifting and supporting a human breast that would be obvious to one skilled in the art without deviating from the scope of this invention. In an embodiment, the second adhesive layer 106 has a height of 1.5 inches, a base width of 5.25 inches and a top width of 1.5 inches.

The top lining 108 can be located at the top of the breast lift tape 100 adjacent to the second adhesive layer 106. The top lining 108 provides the breast lift tape 100 with a section of the breast lift tape 100 which can be grasped and lifted as the breast lift tape 100 is being applied. The top lining 108 can also be grasped and pulled on to remove the breast lift tape 100 after use. The top lining 108 may or may not include an adhesive. FIG. 1 illustrates the top lining 108 as having a rectangular shape; however, it is to be understood that the top lining 108 can have any shape which would be obvious to one skilled in the art without deviating from the scope of the invention. In an embodiment, the top lining has a height of 0.5 inches and a width of 1.5 inches.

Figure 3:
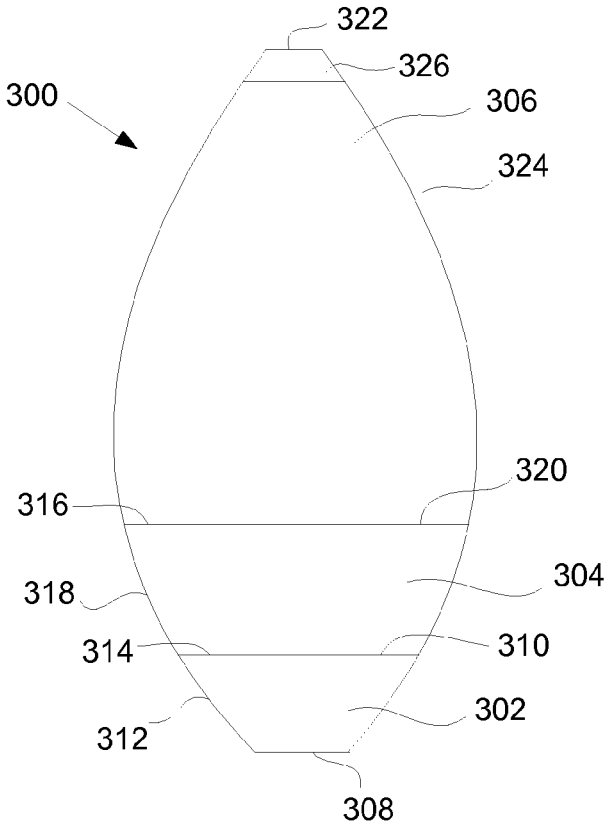
FIG. 3 illustrates a view of the bottom surface of an embodiment of the invention.
Figure 4:
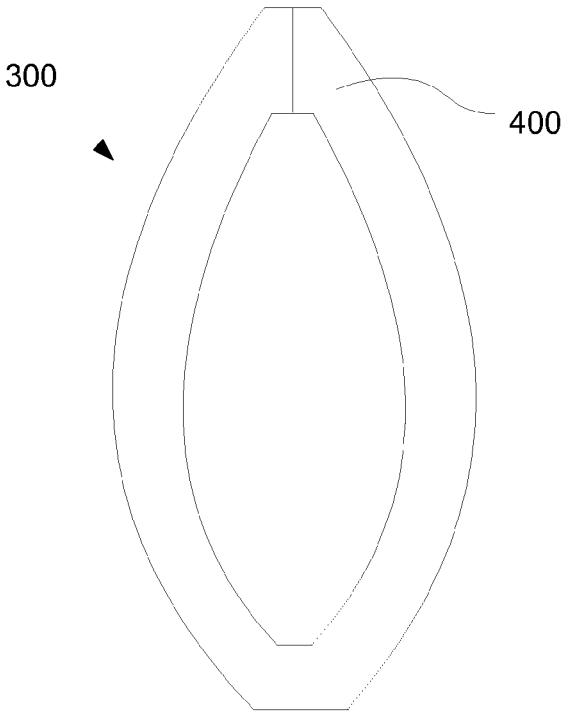
FIG. 4 illustrates a view of the top surface of an embodiment of the invention.

FIGS. 3 and 4 illustrate another embodiment of a breast lift tape. FIG. 3 illustrates the bottom surface of an embodiment (which includes the adhesive layer) while FIG. 4 illustrates the top surface of an embodiment. Referring now to FIG. 3, the breast lift tape, generally numbered 300, is generally egg-shaped and includes a first adhesive section 302, a non-adhesive section 304 and a second adhesive section 306. In an embodiment, the height of the breast lift tape is approximately 5.25 inches with the width being approximately 2.7 inches as its widest point.

The first adhesive section 302 is located at the base of the breast lift tape 300. The first adhesive section 302 is shaped as a trapezoid with the bottom portion 308 being narrower than the top portion 310 and the sides 312 being arcuate. The first adhesive section 302 includes an adhesive and can be applied to the area of the breast below the nipple and areola. In an embodiment, the height of the first adhesive section is 0.75 inches.

The non-adhesive section 304 can be located between the first adhesive section 302 and the second adhesive section 306 as illustrated in FIG. 3. The non-adhesive section 304 is intended to overlay and/or conceal the nipple and areola. In an embodiment, the non-adhesive section 304 can be shaped as a trapezoid with the bottom portion 314 being narrower than the top portion 316 with the sides 318 being arcuate. In this embodiment, the non-adhesive section 304 extends completely across the width of the breast lift tape 300. In another embodiment, the non-adhesive section 304 does not extend across the width of the breast lift tape 300. The non-adhesive section 304 may include any shape, such as a circle, star, rectangle, etc., as long as it is sufficiently large enough to cover the nipple and areola. Accordingly, the non-adhesive section 304 can also be surrounded by adhesive material, thereby allowing the breast lift tape 300 to be secured to the side of the breast. The non-adhesive section 304 can be created by placing any non-adhesive material on an underlying adhesive surface. The thickness of the non-adhesive section 304 can be varied depending on the desired level of concealment for the nipple. The non-adhesive section 304 may be opaque or non-opaque. In an embodiment, the height of the non-adhesive section 304 is 1 inch.

The second adhesive layer 306 can be located on the opposite side of the non-adhesive layer 304 as the first adhesive layer 302. The second adhesive layer 306 includes an adhesive and can be applied to a predetermined area of the breast and/or chest above the nipple and areola. The second adhesive section 306 is also shaped as a trapezoid, this time with the bottom portion 320 being wider than the top portion 322 and the sides 324 being arcuate. The trapezoidal shape of the second adhesive section 304 helps to conceal the breast lift tape 300 under the user's clothing while also providing sufficient surface area to support the weight of the breast. In an embodiment, a top lining 326 which does not include any adhesive can be incorporated into the breast lift tape 300. The top lining 326 can be grasped and pulled on to remove the breast lift tape after use. In an embodiment, the height of the second adhesive layer 306 is approximately 3.5 inches.

Referring back to FIG. 2, the top surface of an embodiment of the breast lift tape 100 is shown. Given the generally thin material used to create the breast lift tape 100, the breast lift tape 100 may require extra care in handling. Accordingly, in an embodiment, the top surface of the breast lift tape 100 can include a top peel-away layer 200. The top peel-away layer 200 can be used to sustain the shape of the breast lift tape 100 while the breast lift tape 100 is being applied and then be removed once the breast lift tape 100 is secured to the user's body. In an embodiment, the top peel-away layer 200 can be a band which provides a frame around the periphery of the breast lift tape 100 as illustrated in FIG. 2. In another embodiment, the top peel-away layer can cover the entire top surface of the breast lift tape 100. In an embodiment, the top peel-away layer 200 can be polycoated kraft paper having an adhesive on one side. The top peel-away layer 200 can also be made of any other material which best accomplishes the goal of sustaining the shape of the breast lift tape 100 as it is being applied which would be obvious to one skilled in the art without deviating from the scope of this invention.

Referring back to FIG. 4, the top surface of an embodiment of the breast lift tape 300 is shown. Again, in an embodiment, the top surface of the breast lift tape 300 can include a top peel-away layer 400. The top peel-away layer 400 can be used to sustain the shape of the breast lift tape 300 while the breast lift tape 300 is being applied and then be removed once the breast lift tape 300 is secured to the user's body. In an embodiment, the top peel-away layer 400 can be a band which provides a frame around the periphery of the breast lift tape 300 as illustrated in FIG. 4. In an embodiment, the top peel-away layer can cover the entire top surface of the breast lift tape 300. In an embodiment, the top peel-away layer 400 can be polycoated kraft paper having an adhesive on one side. The top peel-away layer 300 can also be made of any other material which best accomplishes the goal of sustaining the shape of the breast lift tape 300 as it is being applied which would be obvious to one skilled in the art without deviating from the scope of this invention.

The breast lift tape 100, 300 may be made from any conventional gas permeable, pressure sensitive adhesive tape. In an embodiment, the breast lift tape 100, 300 can be made of a clear urethane film. The breast lift tape 100, 300 can also be made of any other non-opaque material including, but not limited to, rubber latex, cellulose acetate, polyethylene, polyvinyl chloride, polyethylene terphthalate, polyvinylidene chloride, and polyethyl acrylate. The non-opaque material used to form the breast lift tape 100, 300 can help to conceal the tape 100, 300 during use. It is also advantageous for the breast lift tape 100, 300 to be thin in order to further conceal the tape 100, 300 during use. In an embodiment, the breast lift tape 100, 300 can be elastic to promote adhesion between the breast lift tape 100, 300 and the skin. In an embodiment, the breast lift tape 100, 300 may include different colors, especially if it is desired by the user for the breast lift tape 100, 300 to be noticeable. It is also noted that the breast lift tape 100, 300 may be worn as outerwear as opposed to simply be concealed under the user's clothing. Accordingly, in an embodiment, the breast lift tape 100, 300 is opaque and is made to be thicker and bigger than the embodiment of the breast lift tape 100, 300 which is intended to be worn underneath the user's clothing.

While embodiments and applications of this invention have been shown and described, it would be apparent to those skilled in the art having the benefit of this disclosure, that many more modifications than mentioned above are possible without departing from the inventive concepts herein.

The invention claimed is:

1. A cosmetic tape for lifting and supporting a human breast of a user, comprising:

a cosmetic tape having a non-adhesive top surface and a bottom surface, wherein an adhesive is applied to at least a portion of the bottom surface;

said bottom surface including a first adhesive section at a base of the cosmetic tape adapted to be attached to the breast below a nipple, a second adhesive section at a top of the cosmetic tape adapted to be attached to the user above the nipple, and a non-adhesive section adapted to cover the nipple, said non-adhesive section adjacent to the first adhesive section and the second adhesive section;

said top surface including a top peel-away layer removably attached to said cosmetic tape in order to sustain the shape of the breast lift tape until the cosmetic tape is applied to the user's breast; and wherein the first adhesive section and the non-adhesive section are located entirely within a lower half of the cosmetic tape proximal to the base of the cosmetic tape.

2. The cosmetic tape as set forth in claim 1 comprising a top tab lining at the top of the cosmetic tape adjacent to the second adhesive section for grasping by the user.

3. The cosmetic tape as set forth in claim 1 wherein the cosmetic tape is egg shaped.

4. The cosmetic tape as set forth in claim 1, the second adhesive section having a trapezoidal shape.

5. The cosmetic tape as set forth in claim 1 wherein said non-adhesive section extends from one side of the cosmetic tape to the opposite side of the cosmetic tape, thereby separating the first adhesive section from the second adhesive section of the cosmetic tape.

6. The cosmetic tape as set forth in claim 1 wherein the cosmetic tape is made of a gas permeable, pressure sensitive adhesive tape.

7. The cosmetic tape as set forth in claim 1 wherein the cosmetic tape is made of a non-opaque material.

8. The cosmetic tape as set forth in claim 1 wherein the cosmetic tape is made of a clear urethane film.

9. The cosmetic tape as set forth in claim 1 wherein the top peel-away layer is made of a polycoated kraft paper.

10. The cosmetic tape as set forth in claim 1 wherein the top peel-away layer is a band which provides a frame around a periphery of the top surface of the cosmetic tape, wherein at least a portion of the top surface of the cosmetic tape is not covered by the top peel-away layer.

11. The cosmetic tape as set forth in claim 1 wherein the non-adhesive section is rectangular in shape.

12. The cosmetic tape as set forth in claim 1 wherein the non-adhesive section is shaped as a trapezoid, a bottom portion of the non-adhesive section being narrower than a top portion of the non-adhesive section, the sides of the non-adhesive section being arcuate.

13. The cosmetic tape as set forth in claim 1 wherein the first adhesive section is shaped as a trapezoid, a bottom portion of the first adhesive section being narrower than a top portion of the first adhesive section, the sides of the first adhesive section being arcuate.

14. The cosmetic tape as set forth in claim 1 wherein the cosmetic tape is made from an elastic material.

15. The cosmetic tape as set forth in claim 1 wherein the cosmetic tape is made of an opaque material.

16. The cosmetic tape as set forth in claim 11 wherein the cosmetic tape is worn as outerwear.

17. The cosmetic tape as set forth in claim 1 wherein the top peel-away layer includes a handle extending away from the cosmetic tape.

18. The cosmetic tape as set forth in claim 1 wherein said non-adhesive section does not extend from one side of the cosmetic tape to the opposite side of the cosmetic tape, thereby allowing the non-adhesive section to be completely surrounded by adhesive material.

19. A cosmetic tape for lifting and supporting a human breast of a user, comprising:

a cosmetic tape having a non-adhesive top surface and a bottom surface, wherein an adhesive is applied to at least a portion of the bottom surface;

said bottom surface including:

a rectangular first adhesive section at a base of the cosmetic tape adapted to be attached to the breast below a nipple;

a trapezoidal second adhesive section at a top of the cosmetic tape adapted to be attached to the user above the nipple; and a rectangular non-adhesive section adapted to cover the nipple, said non-adhesive section located between the first adhesive section and the second adhesive section, said non-adhesive section extending from one side of the cosmetic tape the opposite side of the cosmetic tape, thereby separating the first adhesive section from the second adhesive section of the cosmetic tape;

said top surface including a top peel-away layer removably attached to said cosmetic tape for sustaining the shape of the breast lift tape, said top peel-away layer including a band which provides a frame around a periphery of the top surface of the cosmetic tape;

a rectangular top tab lining at the top of the cosmetic tape adjacent to the second adhesive section for grasping by the user;

wherein the cosmetic tape is made of a clear urethane film and the top peel-away layer is made of a polycoated kraft; and wherein the first adhesive section and the non-adhesive section are located entirely within a lower half of the cosmetic tape proximal to the base of the cosmetic tape.

20. A cosmetic tape for lifting and supporting a human breast of a user, comprising:

a cosmetic tape having a non-adhesive top surface and a bottom surface, wherein an adhesive is applied to at least a portion of the bottom surface, said cosmetic tape being egg shaped;

said bottom surface including:

a first adhesive section at a base of the cosmetic tape adapted to be attached to the breast below a nipple, said first adhesive section being shaped as a trapezoid, a bottom portion of the first adhesive section being narrower than a top portion of the first adhesive section, the sides of the first adhesive section being arcuate;

a second adhesive section at the top of the cosmetic tape adapted to be attached to the user above the nipple, said second adhesive section being shaped as a trapezoid, a bottom portion of the second adhesive section being wider than a top portion of the second adhesive section, the sides of the second adhesive section being arcuate; and a non-adhesive section adapted to cover the nipple, said non-adhesive section located between the first adhesive section and the second adhesive section, said non-adhesive section extending from one side of the cosmetic tape the opposite side of the cosmetic tape, thereby separating the first adhesive section from the second adhesive section of the cosmetic tape, wherein said non-adhesive section is shaped as a trapezoid, a bottom portion of the non-adhesive section being narrower than a top portion of the non-adhesive section, the sides of the non-adhesive section being arcuate;

said top surface including a top peel-away layer removably attached to said cosmetic tape for sustaining the shape of the breast lift tape, said top peel-away layer including a band which provides a frame around the periphery of the top surface of the cosmetic tape;

wherein said top peel-away layer includes a handle extending away from the cosmetic tape;

wherein the cosmetic tape is made of a clear urethane film and the top peel-away layer is made of a polycoated kraft paper; and wherein the first adhesive section and the non-adhesive section are located entirely within a lower half of the cosmetic tape proximal to the base of the cosmetic tape.

* * * * *